US011986724B2

(12) United States Patent
Kildevaeld

(10) Patent No.: US 11,986,724 B2
(45) Date of Patent: May 21, 2024

(54) SYSTEM AND METHOD OF CONFIGURING SKIS INTO AN EMULATION SNOWBOARD

(71) Applicant: Michael Kildevaeld, Massachussetts, MA (US)

(72) Inventor: Michael Kildevaeld, Massachussetts, MA (US)

( * ) Notice: Subject to any disclaimer, the term of this patent is extended or adjusted under 35 U.S.C. 154(b) by 0 days.

(21) Appl. No.: 17/553,407

(22) Filed: Dec. 16, 2021

(65) Prior Publication Data

US 2023/0097209 A1 Mar. 30, 2023

Related U.S. Application Data

(60) Provisional application No. 63/133,566, filed on Jan. 4, 2021.

(51) Int. Cl.

| | |
|---|---|
| ***A63C 5/03*** | (2006.01) |
| ***A63C 5/12*** | (2006.01) |
| ***A63C 11/00*** | (2006.01) |
| ***A63C 11/20*** | (2006.01) |
| *A63C 10/00* | (2012.01) |

(52) U.S. Cl.

CPC ..... *A63C 5/031* (2013.01); *A63C 5/033* (2013.01); *A63C 5/12* (2013.01); *A63C 11/00* (2013.01); *A63C 11/20* (2013.01); *A63C 10/00* (2013.01)

(58) Field of Classification Search

CPC ..... A63C 5/031; A63C 5/033; A63C 5/12; A63C 11/00; A63C 11/20; A63C 10/00; A63C 5/003; A63C 5/06; A63C 2203/06; A63C 5/00; A63C 5/03; A63C 5/02; A63C 10/14; A63C 2203/46; A63C 5/16

See application file for complete search history.

(56) References Cited

U.S. PATENT DOCUMENTS

| | | | | |
|---|---|---|---|---|
| 3,326,564 A * | 6/1967 | Heuvel | ..... | A63C 5/122 280/602 |
| 3,802,714 A * | 4/1974 | Freegard | ..... | A63C 5/033 280/607 |
| 4,565,386 A * | 1/1986 | Crainich | ..... | A63C 5/075 280/607 |

(Continued)

FOREIGN PATENT DOCUMENTS

| | | | | |
|---|---|---|---|---|
| CN | 205031870 U * | 2/2016 | | |
| DE | 29908027 U1 * | 11/1999 | ..... | A63C 5/02 |

(Continued)

*Primary Examiner* — James A Shriver, II
*Assistant Examiner* — Michael T. Walsh
(74) *Attorney, Agent, or Firm* — Melvin K. Silverman

(57) ABSTRACT

A system, configuration, and method for converting a pair of skis to perform as an emulation snowboard is provided. The system includes a pair of skis, and a coupling device including a platform having an upper planar surface with a plurality of mounting locations with mounting system therein. The mounting system couples the skis together and provides a surface on which a pair of bindings may be affixed. The steps for conversion include providing a pair of skis, removing a ski binding from each ski in the pair of skis, if a binding is installed on either ski in the pair of skis, providing a platform with a mounting system, utilizing the mounting system to affix the platform to each ski in the pair of skis, and attaching a pair of snowboard bindings to the platform.

9 Claims, 17 Drawing Sheets

(56) References Cited

U.S. PATENT DOCUMENTS

| | | | | | |
|---|---|---|---|---|---|
| 5,083,809 | A * | 1/1992 | Stampacchia | A63C 5/031 | 280/607 |
| 5,129,668 | A * | 7/1992 | Hecht | A63C 9/007 | 280/607 |
| 5,301,965 | A * | 4/1994 | Floreani | A63C 5/0405 | 280/600 |
| 5,558,354 | A * | 9/1996 | Lion | A63C 5/033 | 280/607 |
| 6,341,786 | B1 * | 1/2002 | Kermis | A63C 5/031 | 280/22.1 |
| 6,773,021 | B2 * | 8/2004 | Breuer | A63C 5/033 | 280/7.14 |
| 7,484,738 | B2 * | 2/2009 | Belt | A63C 5/031 | 280/14.26 |
| 8,186,693 | B2 * | 5/2012 | Kortschot | A63C 17/00 | 280/11.19 |
| 9,174,663 | B2 * | 11/2015 | Reinig | A63C 5/031 | |
| 9,724,590 | B2 * | 8/2017 | Reinig | A63C 5/06 | |
| 2017/0095724 | A1 * | 4/2017 | De Loore | A63C 5/06 | |

FOREIGN PATENT DOCUMENTS

| | | | | | |
|---|---|---|---|---|---|
| DE | 102007034228 | B3 * | 1/2009 | A63C 5/065 | |
| DE | 102005052587 | B4 * | 7/2010 | A63C 5/031 | |
| DE | 102010000977 | A1 * | 7/2011 | A63C 5/031 | |
| EP | 1046413 | A1 * | 10/2000 | A63C 5/031 | |
| NL | 8400572 | A * | 9/1985 | A63C 5/06 | |
| SI | 20784 | A * | 6/2002 | | |
| WO | WO-2011099155 | A1 * | 8/2011 | A63C 5/02 | |

* cited by examiner

SYSTEM AND METHOD OF CONFIGURING SKIS INTO AN EMULATION SNOWBOARD

CROSS REFERENCE TO RELATED APPLICATIONS

This application claims the benefit under 35 USC 119(e) of provisional patent application Ser. No. 63/133,566, Filed Jan. 4, 2021, all of which are incorporated by reference in its entirety.

FIELD OF INVENTION

The invention generally relates to converting independent skis into a mono-board with functional capabilities of a snowboard.

BACKGROUND

Inventions in the field typically fall into two categories: a coupling device turning skis into a forward-facing mono-ski, or a snowboard split in half to adapt independent platforms for increased non-riding maneuverability. Both categories have functional purposes for their designs, namely, the mono-ski is for a style of skiing where a user is facing forward, with an orientation of a user's foot also facing forward. The splitboard operates mainly to allow a user to access areas that are not serviced by ski lifts, where the use of cross-country skis would allow a user faster traverse of the landscape.

A splitboard is a type of snow sport equipment that combines the features of a snowboard and snow skis. Splitboards can be operationally separated into two splitboard skis or coupled to create a unitary snowboard. Some users operate the splitboard as separate splitboard skis, known as touring mode, when climbing uphill or cross-country skiing. Users also operate the splitboard as a joined snowboard, known as riding mode, when gliding downhill slopes.

Patents, such as U.S. Pat. No. 8,708,371 to Richard Balun, titled "Reconfigurable Snowboard/Downhill Skis" attempt to combine skis and snowboards into a new product. However, the embodiments shown and described would fail to produce a device capable of both snowboarding maneuvers, and techniques employed while downhill skiing on alpine skis. Thus, the availability of activities able to be accomplished on Balun's board are limited to those of a snowboard. Further, Balun's device is also coupled the two platforms at the tip and tail, which would increase vibrations in the board causing issues with seamless gliding needed to achieve proper emulation of both skiing and snowboarding.

Thus, there exists a need in the industry for a device that is capable of combining skis that are capable of operating with the capabilities of a snowboard, but are independently capable of operating as downhill skis. Further, it is also a need in the industry for a device that is capable of combining "off-the-shelf" downhill skis into an emulation snowboard that is capable of quick conversion and operation as either, that may use currently available skis, bindings, and the like, but still provide features of both winter activities.

The current invention seeks to fill this gap in the industry with the invention as shown and described herein.

SUMMARY OF THE INVENTION

Provided is a system and configuration of a pair of skis to perform as an emulation snowboard. The system includes a pair of skis, and a coupling device including a platform having an upper planar surface with a plurality of mounting locations wherein each mounting location is configured to receive a mounting system. The mounting system couples the skis together and provides a surface on which a pair of bindings may be affixed. Each mounting system is configured to affix the platform to a pair of skis thereby forming the pair of skis into an emulation snowboard, wherein the platform combines each ski in the pair of skis in parallel allowing each ski to flex independent of each other. The platform includes a plurality of binding apertures, whereby the apertures are configured for receiving mounting screws for snowboard bindings.

Further provided is a method for converting a pair of skis into a mono board for emulation of snowboarding. The method comprises providing a pair of skis, removing a ski binding from each ski in the pair of skis, if a binding is installed on either ski in the pair of skis, providing a platform with a mounting system, utilizing the mounting system to affix the platform to each ski in the pair of skis, and attaching a pair of snowboard bindings to the platform.

It is an object of the invention to provide a multi-use snow sport system that is capable of emulating maneuvers of a snowboard, but also may be deconstructed into operable downhill skis.

It is also an object of the invention to provide a system capable of calibration to emulate both a convex and concave snowboard through manipulation of the hardware in the mounting system.

It is yet further an object of the invention to provide a system capable of quick construction and deconstruction of the device for a fast transition from skis to an emulation snowboard, and back into skis.

It is also an object of the invention to provide a system that reduces unwanted vibrations that affect performance of the snow device.

It is additionally an object of the invention to provide a system that couples two skis, but allows for flex between the mounting points to provide for proper radial turning.

It is yet further an object of the invention to provide a platform capable of slight flex that is also torsionally rigid.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

The present invention provides a solution to coupling a pair of skis to form a mono-board, with a capability of maneuvering equivalent to maneuvering accomplished on a snowboard, thereby resulting in an emulation snowboard, as shown herein in FIGS. 1-17. Snowboarding maneuvers provide unique challenges that simply coupling skis together cannot perform.

The invention described herein is for a platform to couple off-the-rack alpine skis using a configurable mounting system that is adaptable for different riding styles and emulates riding a snowboard. The platform is also configured to receive snowboard bindings to allow proper stance when riding the device.

A user may convert the skis to an emulation snowboard by removing the bindings, if a pair of bindings is installed. The bindings are removed rather than incorporated because, among other things, bindings would increase height, which could make the system more top heavy which could affect the feel as an emulation snowboard. Without the bindings on the skis, the user may attach mounting brackets to the holes of the skis or attach the platform directly to the ski. While appropriate holes will likely be present in skis that have been used with bindings, new skis may require a user to drill new holes. In some embodiments, a race plate or similar plate may be added. The race plate allows the natural flexibility of the ski to remain unimpeded by any rigidity of the platform, even though the platform itself will have some flexibility. When the platform is affixed to the skis, whether directly or by a bracket or race plate, a rider may attach snowboard bindings to apertures in the platform for a natural snowboard feel.

Figure 4:
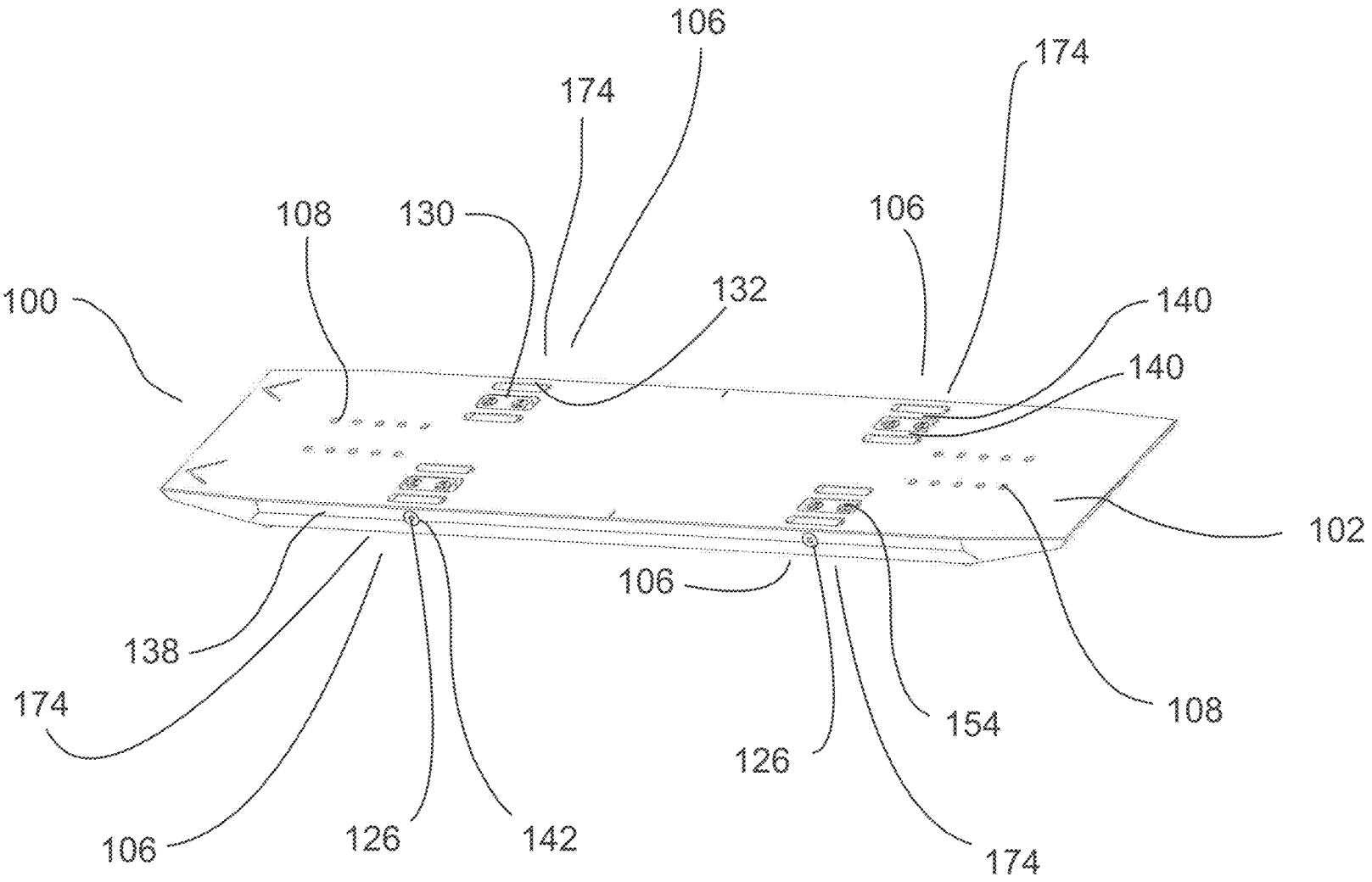
FIG. 4 is side isometric view of the platform of the system with mounting system inserted.
Figure 5:
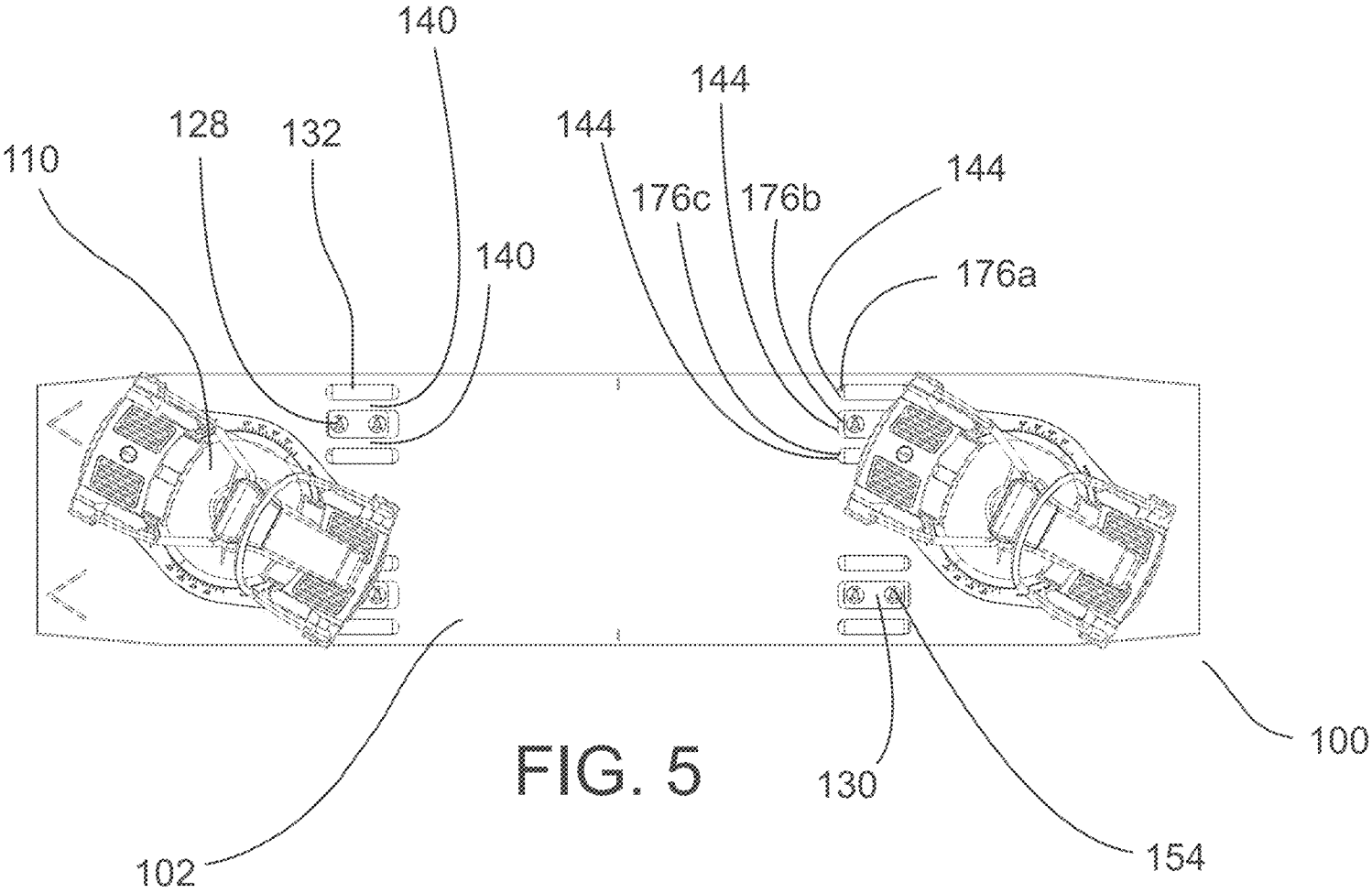
FIG. 5 is a top view of the platform with a pair of bindings and the mounting system inserted.
Figure 6:
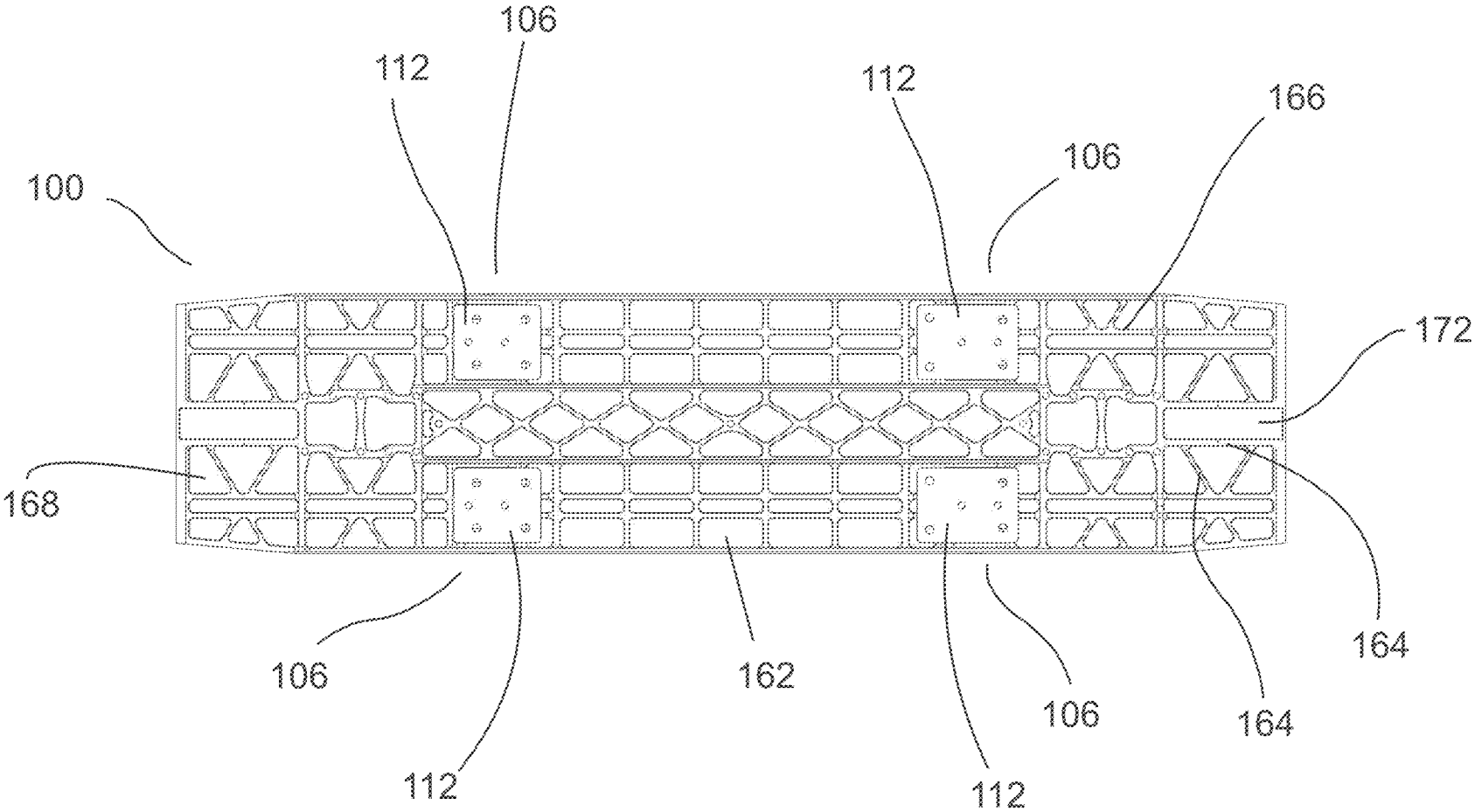
FIG. 6 is a bottom view of the platform.
Figure 7:
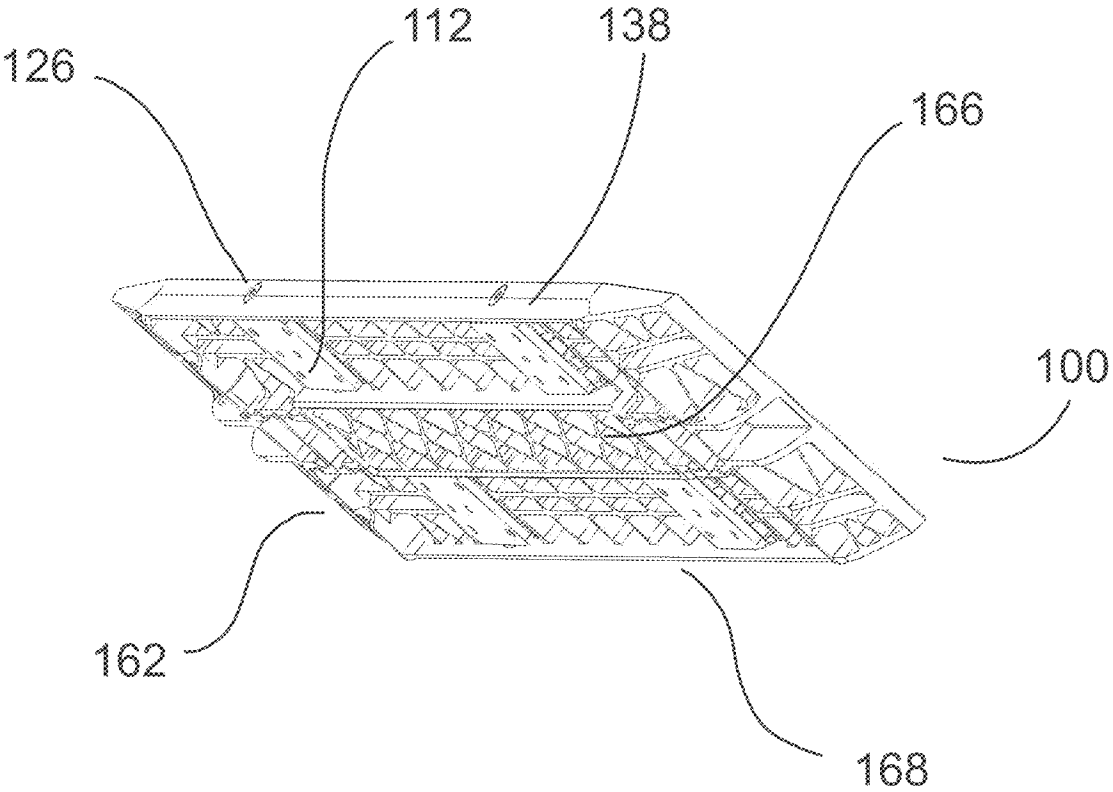
FIG. 7 is a isometric bottom view of the platform.
Figure 8:
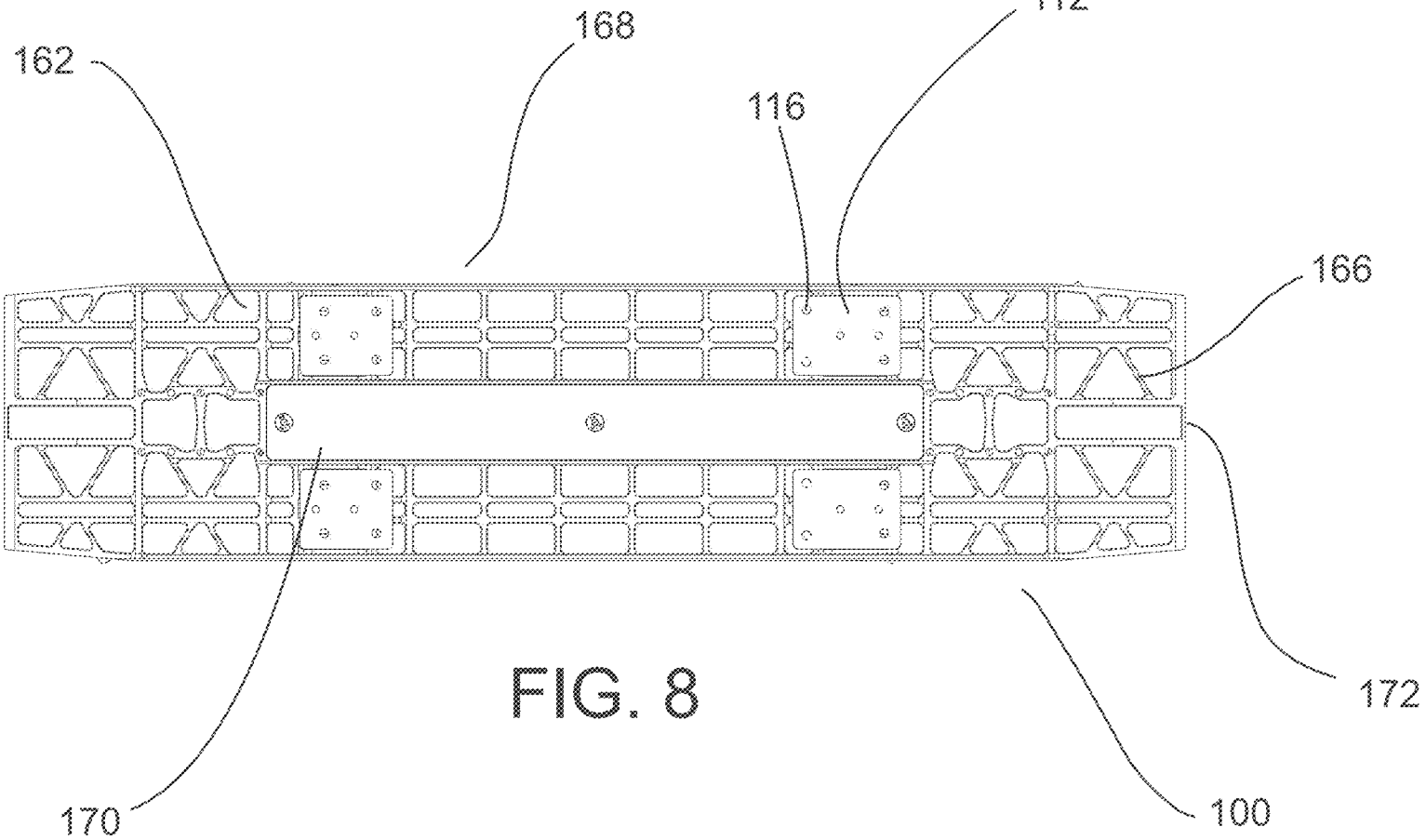
FIG. 8 is a bottom view of the platform with a platform plate affixed.
Figure 9B:
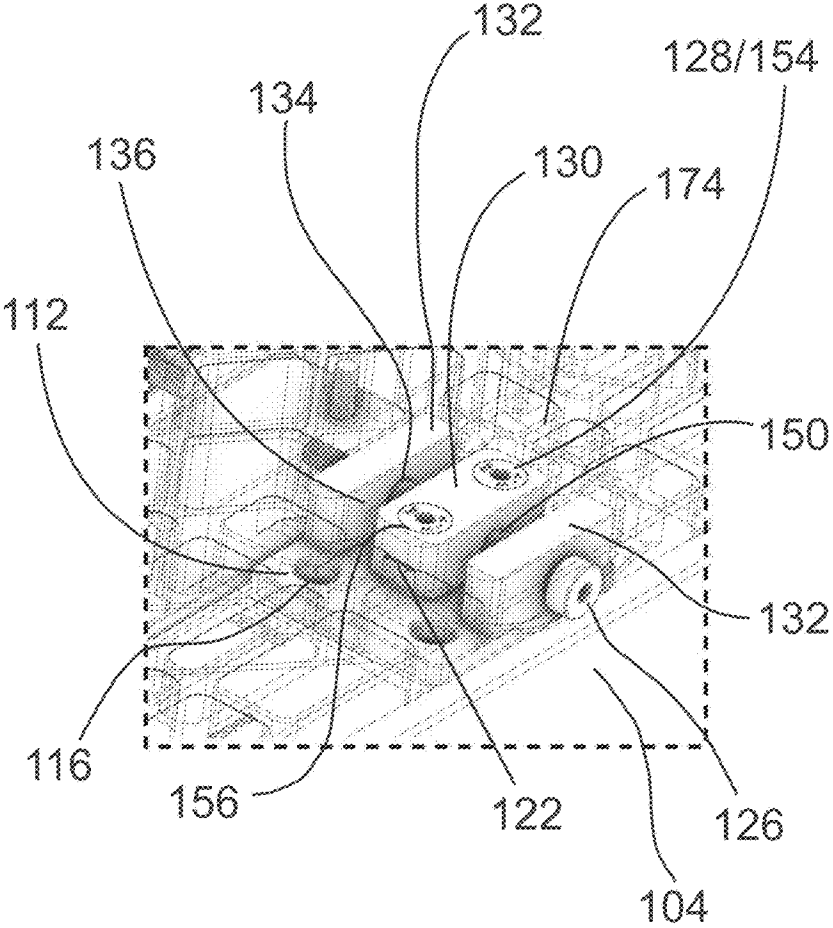
FIG. 9B is an isolated three-dimensional isometric top view of the locking portion of the mounting system with portions of the platform shown in phantom.
Figure 9A:
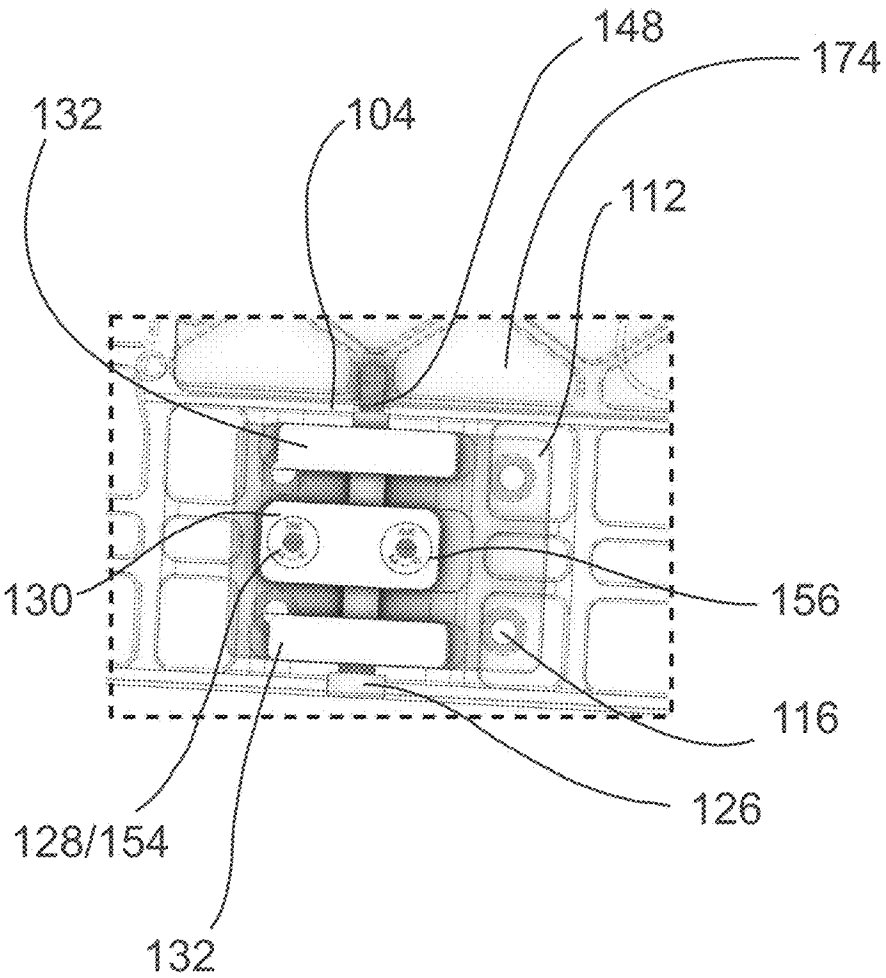
FIG. 9A is an isolated top view of the locking portion of the mounting system with portions of the platform shown in phantom.
Figure 10B:
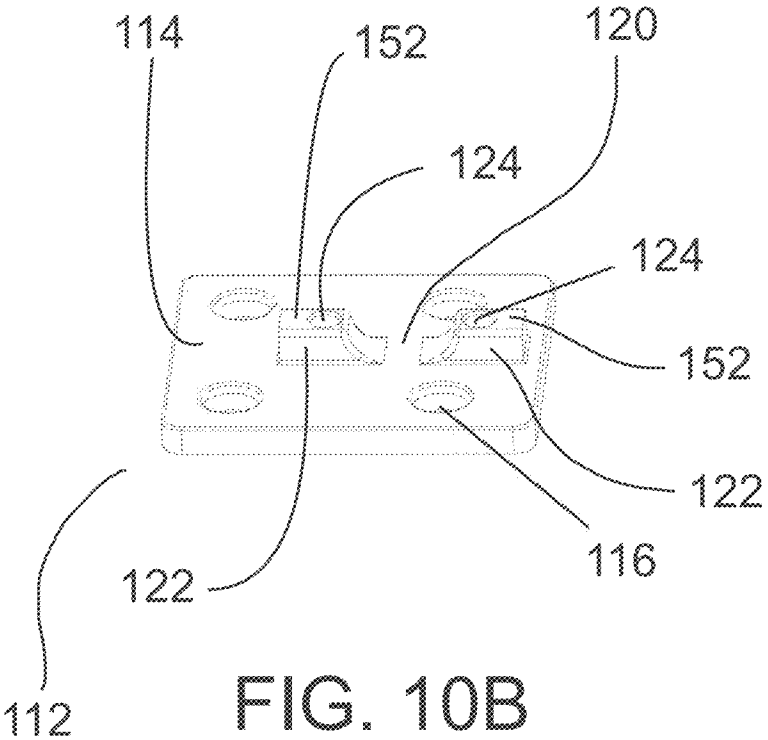
FIG. 10B is an isometric top view of a rear bracket of the mounting system.
Figure 10A:
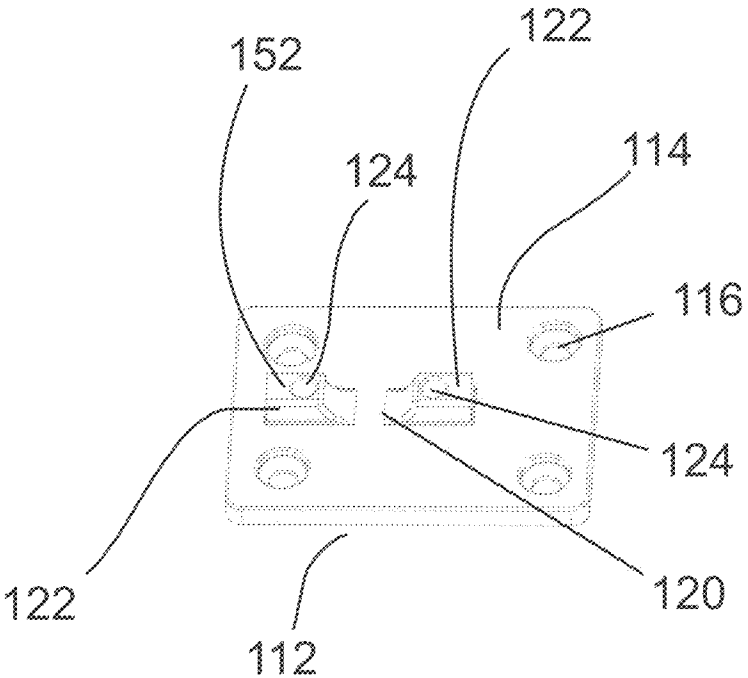
FIG. 10A is an isometric top view of a front bracket of the mounting system.

The platform can be affixed to the skis in in different configurations, but in the illustrated embodiment, the user will affix the platform using a mounting system recessed into the platform, as may be seen in FIG. 4. The recessing of the mounting system allows the system to operate without obstructing the snowboard bindings, shown in FIG. 5. The disclosed embodiment uses a system capable of slidability to ensure the skis may flex like a typical snowboard. That is, a platform affixed to the top of skis will add a level of rigidity pushing back on the skis. A typical snowboard only has the flex of the board itself. Therefore, by allowing the connection of the platform to have connection points that are slidably contained rather than fastened, allows the skis to curvedly flex as needed on a mountain, as the connection point slides forward and back. The illustrated way of achieving this is to configure an elongated containment opening (referred to herein as the channel) that allows the shoulder bolt to be contained within the boundaries of the channel. The elongation provides for sliding, while the boundaries ensure the bolt is secured and the platform will not detach from the skis. This arrangement is known as a slider, as may be particularly appreciated in FIGS. 9A-9B, and 13A-14. A slider lock keeps the shoulder bolt contained between the two protrusions of the channel created.

Another important feature of the illustrated embodiment is the use of slider blocks. These slider blocks are included within the mounting system but affect the different orientations of the skis when attached to the platform, shown in FIGS. 9A-9B and FIGS. 12A-12B. The slider blocks contain an aperture running through the block for the shoulder bolt to pass through, however, the aperture is not in the direct center of the block. In actuality, the aperture is off-center to influence the axial direction of the bolt. While not overly visible, the skis may be adjusted for a positive or negative camber by adjusting the orientation of the aperture in the slider block, thereby shifting the angulation of the bolt. Some embodiments allow for the manipulation of the slider block to provide for a raised platform, or a lowered platform. Users can adjust the blocks to provide for different riding conditions. Some conditions, by way of example and not limitation, include the emulation of a convex snowboard, and emulation of a concave snowboard.

Typical snowboards receive pressure on the board from carving in the snow, which limits excessive vibration. Because the skis are independent, but for the platform, vibration is also a potential issue. When a user shifts his weight and pivots the emulation snowboard to carve, one ski grips the snow while the other is suspended in the air. The ski suspended in the air does not receive consistent external pressure, and oscillations caused by internal tension as well as air pressure may cause vibrations that could affect performance. To solve this problem, the illustrated device includes vibration dampers that attach to the platform, and place pressure on the top surface of the ski. The vibration dampers may be seen in FIGS. 3A and 3B. This pressure keeps the ski from vibrating, thereby allowing smooth riding. Because the skis require an ability to flex in order to curve with the mountain, the vibration dampers are not fastened to a single point on the skis, but rather, place pressure in a non-fastened configuration.

When a user wishes to convert the emulation snowboard back into a pair of skis, the user simply detaches the platform, and reinstalls the ski bindings. Unlike inventions that require a specialized board, the device disclosed herein incorporates a regular pair of skis. This allows the user to use the skis as both an emulation snowboard, and a pair of skis, with all the operation and maneuverability of the respective snow sport, including downhill skiing/snowboarding. This feature sets the current invention apart from any known device. That is, no other device can operate as both a snowboard and a pair of skis without significant limitations on operation of one or both sports. Further, the use of a platform allows for independent adjustment of each ski below, which modifies the characteristics and angulation of the ski independently.

Figure 1:
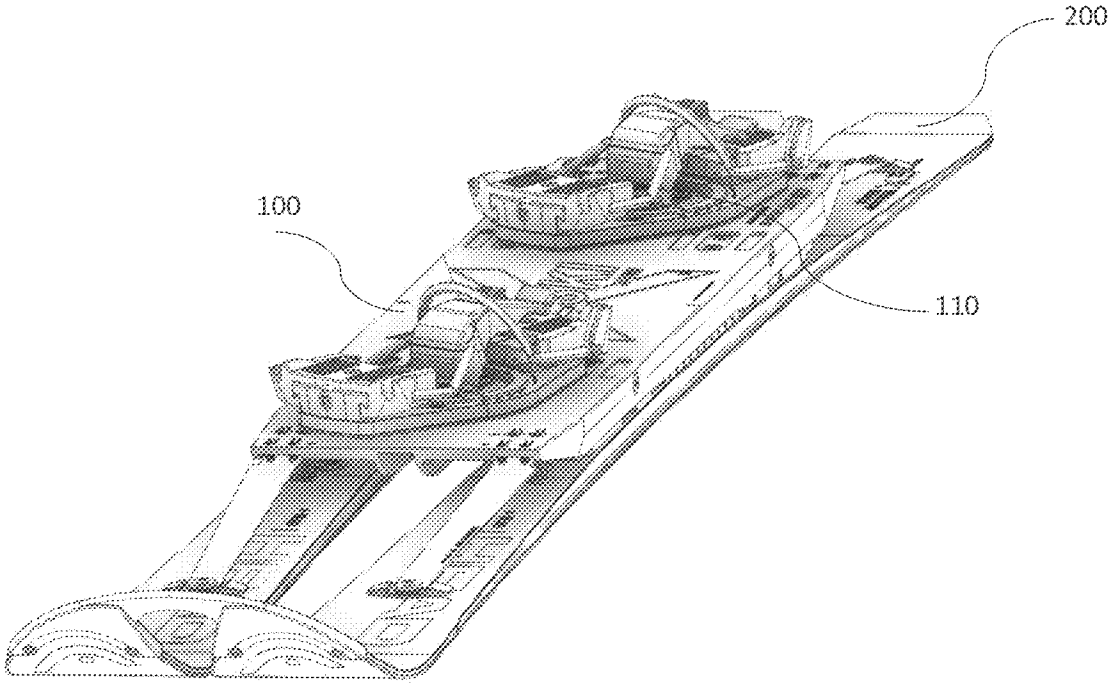
FIG. 1 is a perspective view of the system.
Figure 2A:
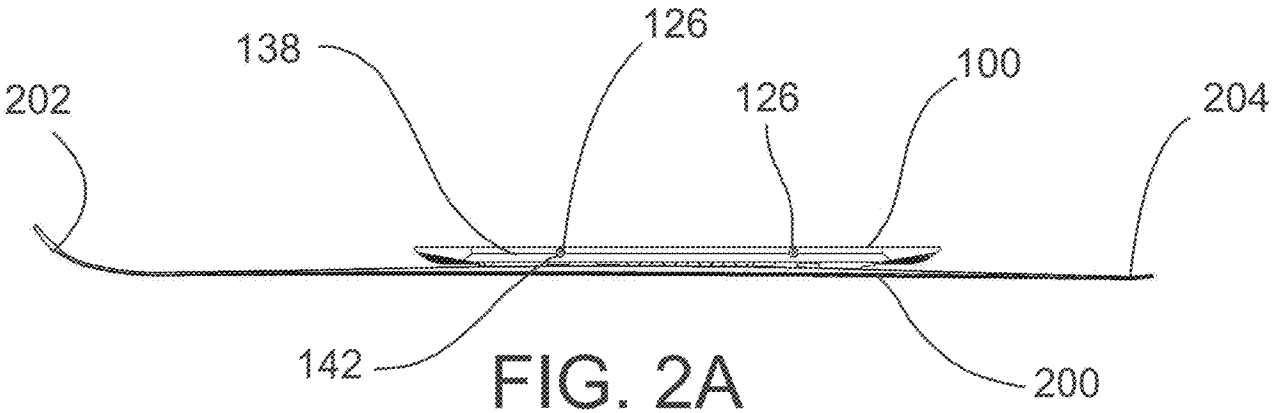
FIG. 2A is a side view of the platform mounted on top of a pair of skis.
Figure 2B:
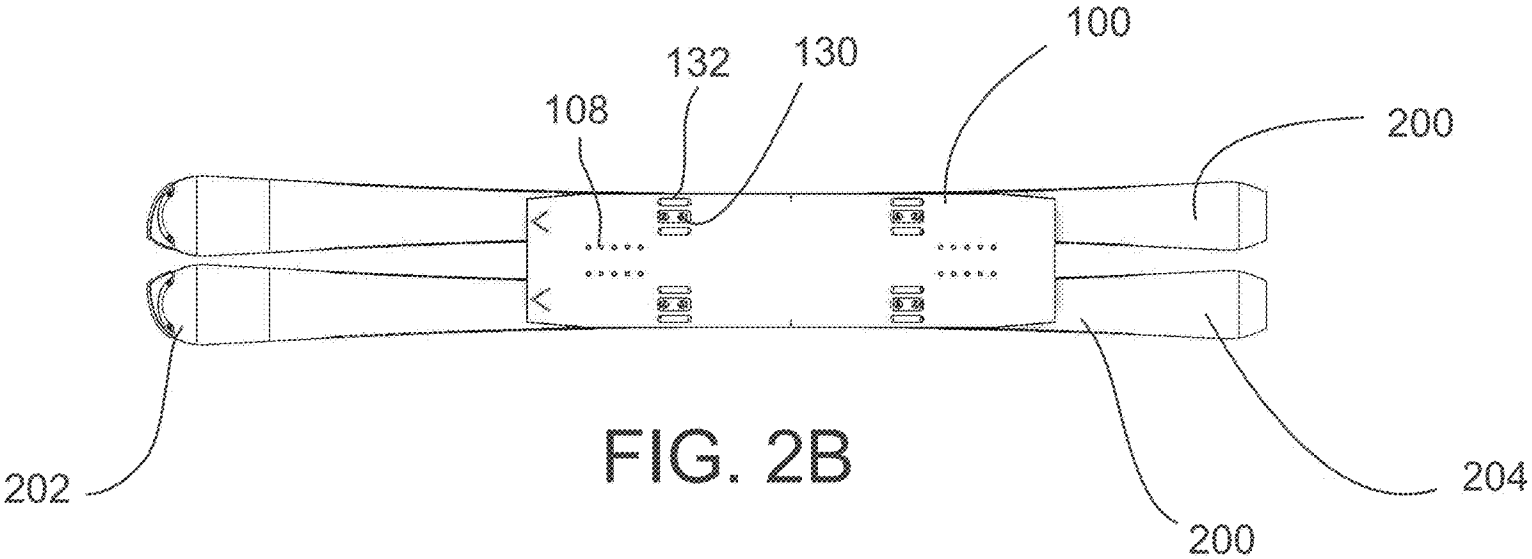
FIG. 2B is a top view of the platform mounted on top of a pair of skis.

The above-described embodiment of the invention is shown in FIGS. 1-17. FIG. 1 illustrates a perspective view of the system that includes a pair of skis coupled to a platform, as described herein. FIGS. 2A-3B illustrate the system showing the combination of the platform mounted on to the skis.

Figure 15B:
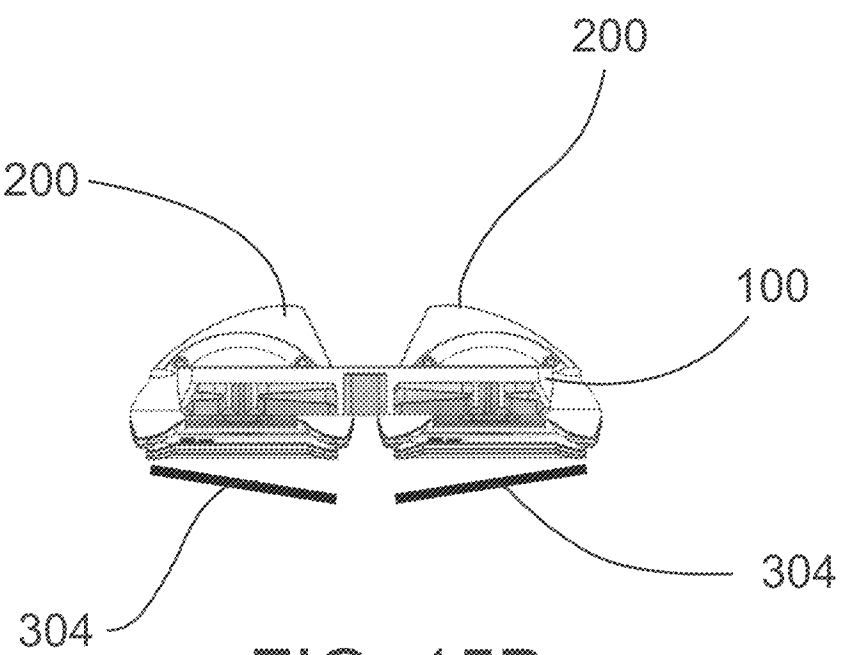
FIG. 15B is a front view of the system when the slider locks are configured to perform as a concave snowboard, illustrated by guidelines in the figure.
Figure 15A:
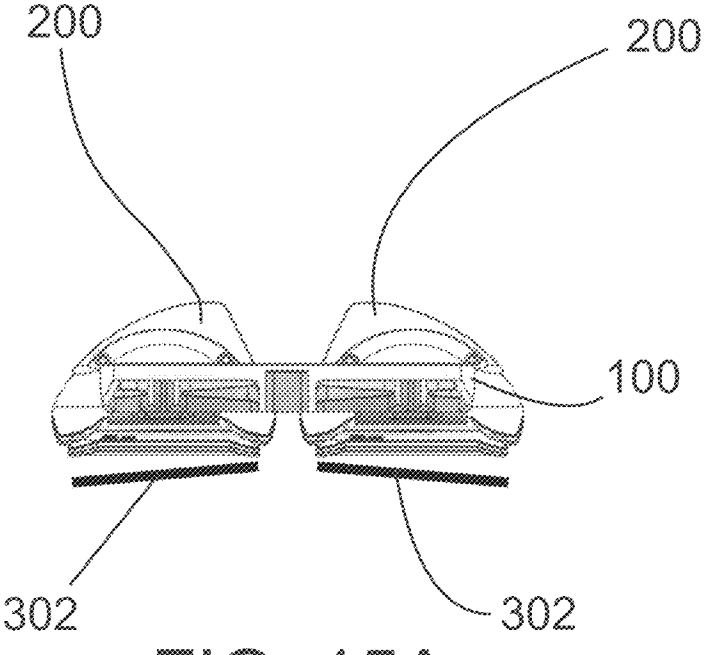
FIG. 15A is a front view of the system when the slider locks are configured to perform as a convex snowboard, illustrated by guidelines in the figure.
Figure 16:
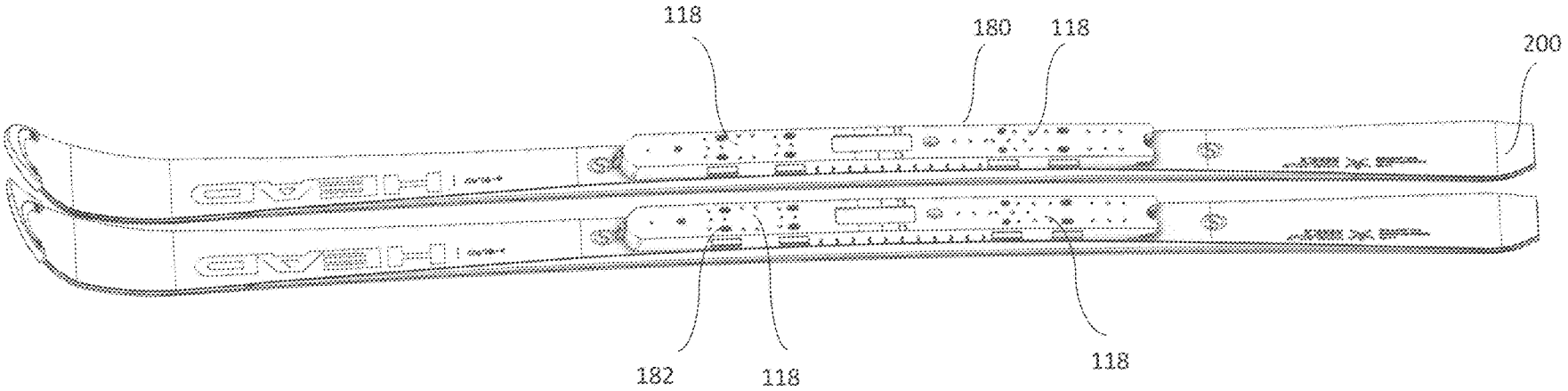
FIG. 16 is a perspective view of a ski with racing plate showing the mounting locations on the ski.
Figure 17:
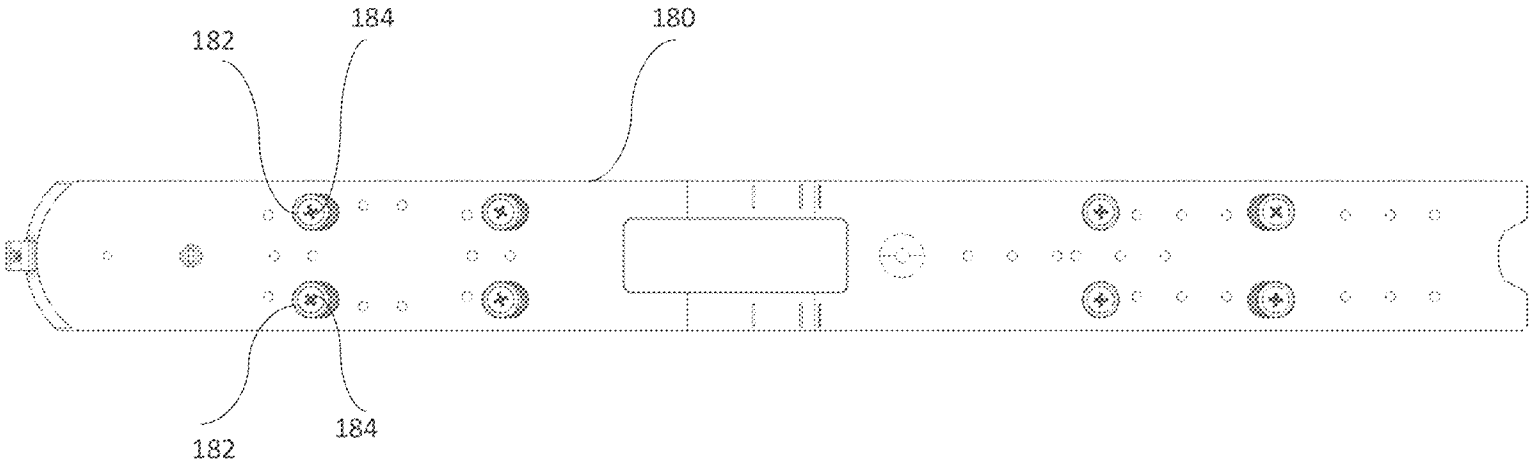
FIG. 17 is an isolated view of the racing plates.

FIGS. 4-8 show the platform in greater detail. FIGS. 9A-14 show an embodiment of a mounting system to attach the platform to the skis. FIGS. 15A and 15B illustrate the variable angulation of the skis, including adjusting the camber to operate as either a concave or convex snowboard. FIGS. 16 and 17 illustrate the additional intermediate plate shown as a race plate.

References to the terms "bolts" and "screws" may be made interchangeably, and are equivalents of each other, as a user may use either a bolt or screw depending on the application.

An exemplary embodiment is shown in FIGS. 1-17. In the exemplary embodiment of a system for using a pair of skis and conversion of them into an emulation snowboard, the system allows the pair of ski to be capable of mimicking maneuvers typically associated with riding a snowboard. The system includes a platform 100 having an upper planar surface 102, as may be particularly seen in FIG. 4. The upper surface 102 has a plurality of mounting locations 106 wherein each mounting location 106 is configured to receive a mounting system 104. Each mounting system 104 is configured to affix the platform 100 to a pair of skis 200 thereby forming the pair of skis 200 into an emulation snowboard. The platform 100 combines the skis 200 in parallel, as shown in FIGS. 2A-3B, allowing each ski 200 to flex independent of each other. The system may include the platform 100 itself configured for skis, or may include a pair of skis 200 within the system. Some embodiments include a pair of off-the-shelf skis, including shaped skis, as shown in FIGS. 2A-3B. The platform 100 includes a plurality of binding apertures 108. These apertures 108 are configured for receiving mounting screws for snowboard bindings 110. The binding apertures 108 may be configured for a perpendicular orientation of alpine snowboard bindings 100, relative to a front-to-back centerline of the platform 100.

In some embodiments, for structural support, the platform 100 includes an underside 162 with at least one support beam 164 and cross-bracing 166 formed into the platform 100, wherein the cross-bracing 166 forms an exoskeletal structure. This may be appreciated in FIGS. 6-8. The platform 100 includes an underside 162 with at least one support beam 164 and cross-bracing 166 formed into the platform 100, wherein the cross-bracing 166 forms an exoskeletal structure that provides for longitudinal flex and torsional rigidity. A plate 170 may be affixed to a centerline 172 of the underside 162 of the platform 100, covering open portions of the underside 162 exoskeleton to prevent snow buildup on the underside 162 of the platform 100.

In some embodiments, the platform 100 also includes a plurality of recessed cavities 174/176*a*/176*b*/176*c* for the mounting system, as shown in FIGS. 2B, 3B, 5, 13B, and 13A. The recesses 174/176*a*/176*b*/176*c* allow the mounting system 104 to fit within the platform 100, where they do not affect mounting of bindings 110, as they provide a flush mount within the platform 100. In the exemplary embodiment herein, the mounting system 104 achieves affixation of the platform 100 to the skis 200 by incorporating a bracket 112 that is mounted to the skis 200, the bracket 112 is aligned with lower openings in the platform 100 corresponding with the four mounting locations 106. The protrusions 122 of the bracket 112, shown in FIGS. 10A, 10B, 13A, and 14 rise up through the opening, wherein the gap between the protrusions creates a channel 120 for a shoulder bolt 126 that is inserted into and through a sidewall aperture 142 in the sidewall 140. The bolt 126 also inserts through the slider blocks 132, which adjust the feel of the skis. To secure the mounting bracket 112 to the platform 100, a slider lock 130 is used, which tightens around the shoulder bolt 126, thereby encasing the bolt 126 between the mounting bracket 112 and slider lock 130. This may be appreciated from FIGS. 9A-14.

The sidewalls 140 in the platform 100 have a series of sidewall apertures 142 therein for the insertion of the shoulder bolt 126. The shoulder bolt 126 extends through a series of apertures therein. These apertures include a sidewall aperture 142, apertures in the sidewalls 1748*a*/178*b* of the cavities 176*a*/176*b*/176*c*, a first slider block 132, through a channel 120 of the mounting bracket 112, and through a second slider block 132 fixing to a threaded opening 148 formed into the platform 100.

In addition to the above-described mounting system 104, other methods, such as implementation of a vertically adjustable bolt that independently raises and lowers each mounting location 104, may be employed. This would allow a mounting bolt to be tightened or loosened by a professional to calibrate the feel to a user's preferences or skill, and to raise and lower certain positions of the platform 100. However, such a system may not provide for front to back slidability for increased flexibility as the exemplary embodiment provides.

In the exemplary embodiment, the mounting system 104 includes a mounting bracket 112, as described above, having a plate 114 with a plurality of apertures 116 therein for bolts or screws that, when inserted, affix the mounting plate 114 to a plurality of ski 200 connection locations 118. The mounting bracket 112 of the mounting system 104 further includes a pair of upward protrusions 122 on the upper surface of the mounting bracket 112, creating a channel 120 therebetween for containing a shoulder bolt 126. This channel 120 may be one size or may vary in size to be elongated to allow forward to back travel of the shoulder bolt 126. This would be important to allow slidable movement of the bolt 126 thereby allowing the skis 200 to flex because they would not be limited by stiffness of the platform 100.

Threaded apertures 124 are included at the top surface 152 of each of the protrusions 122 for complemental engagement with locking bolts 154 that, when inserted through the slider lock 130, affix the slider lock 130 to the mounting bracket 112, and therein, enclosing the channel 120 in the bracket 112 and center cutout 150 in the slider lock to contain the shoulder bolt 126. The slider lock 130 is affixable to the upward protrusions 122 on the mounting bracket 112 by insertion of the locking bolts 154 through a pair of apertures 156 in the slider lock 130 and secured to the threaded apertures 124 in the top surface 152 of the upward protrusions 122.

The slider lock 130, has center cutout 150, and channel 151, wherein the center cutout 150 is configured for the insertion of the shoulder bolt 126, whereby the slider lock 130 bridges a gap between a top 152 of the upward protrusions 122 of the mounting bracket 114 thereby closing off the channel 120 for containment of the shoulder bolt 126. This contains the shoulder bolt 126 vertically, but depending on the channel 120, may allow front to back slidability. In some embodiments, one set (of channels 120 in brackets 114), front or back, is elongated, and the remaining set (of channels 120 in brackets 114) is a single-spaced channel. That is, with some brackets, the channel created between the upward protrusions in the mounting brackets is spaced apart from one another to allow the shoulder bolt a distance of travel, whereby the traveling of the bolt allows the pair of skis the ability to flex beyond the degree of flex of the platform, whereby the flex allows precise emulation of a snowboard, whereby the channel allows each ski in the pair of skis to flex independently from one another. This difference in channel size can be particularly seen in FIGS. 11A-11B as compared to FIGS. 11C-11D. In some embodiments the forward pair of mounting brackets contains space slightly elongated larger than the diameter of the shoulder bolt 126, whereby the rear shoulder bolt may travel between the protrusions of the rear mounting brackets and the forward shoulder bolt is substantially tight between the protrusions of the forward mounting brackets. In some embodiments, the channel 120 between upward protrusions 122 is uniform among all brackets, while the channel 150 on the slider lock 130 varies in size from front to back.

In the exemplary embodiment, a pair of slider blocks 132 for each mounting bracket 112 are included. The slider blocks 132 are parallel to the slider lock 130 in separate recesses 176*a*/176*b*/176*c*; one recess 176*c* to the inside and one recess 176*a* to the outside. Each slider block 132 contains an aperture 134 in its broad side 136 extending through the slider block 132. While some embodiments may have an aperture 134 in the direct center, most embodiments will have a vertically off-centered aperture 134 that allows for multiple configurations of the orientation of the skis 200. The aperture 134 may be vertically asymmetrical, that is, the aperture 134 is not in the vertical center, thereby providing an offset that, when the slider block is flipped, toggles the feel of the system between a convex emulated snowboard to a concave emulated snowboard.

The plurality of recessed cavities 176*a*/176*b*/176*c* can be further defined as four mounting locations 106 on the platform 100. Each mounting location 106 includes a series of three parallel cavities 176*a*/176*b*/176*c* separated by a pair of dividers 178*a*/178*b*. Slider blocks 132 are inserted into two outer cavities 176*a*/176*c* per mounting location 106 and a slider lock 130 is inserted into a center cavity 176*b* per mounting location 106. Each mounting 106 location corresponds with a location of a ski connection location 118. That is, the location 106 of the mounting system 104 of the platform 100 lines up with a location 118 on the skis 200 wherein the mounting system 104 can engage and affix to the skis 200. The plurality of ski connection locations 118 defines four locations, whereby two locations exist per ski 200.

In some embodiments, the plurality of ski connection points 118 defines a connection directly between each ski 200 and the mounting brackets 112, wherein each mounting bracket 112 is coupled to each ski 200 connection point 118. In other embodiments, including embodiments where increase radial turning is desired, an intermediary plate 180 may be located between the mounting bracket 112 and each ski 200. In some embodiments, intermediary plate 180 located between the mounting bracket and each ski 200 may be a race plate. The race plate 180 may be configured to provide additional flexibility for radial turning, wherein the race plate 180 allows the platform 100 the ability to remain stiff while the skis 200 are allowed a degree of flex under the platform 100. The race plate 180 may include a plurality of mounting apertures 182 for complemental connection with a plurality of mounting screws 184, whereby the race plate 180 is secured to the ski 200 by screwing the race plate 180 down, and the mounting bracket 112 is affixed to the race plate 180 by tightening screws 184 though the apertures 116 of the mounting bracket 112 to threaded apertures 182 on the race plate 180.

Figure 3A:
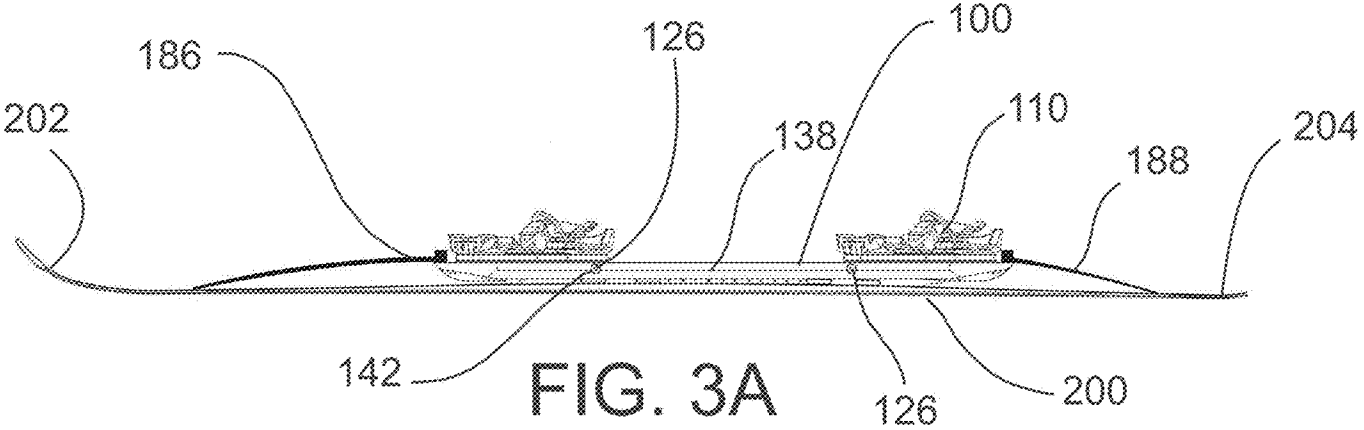
FIG. 3A is a side view of the platform mounted on top of a pair of skis with a pair of bindings and front and rear snow sticks.
Figure 3B:
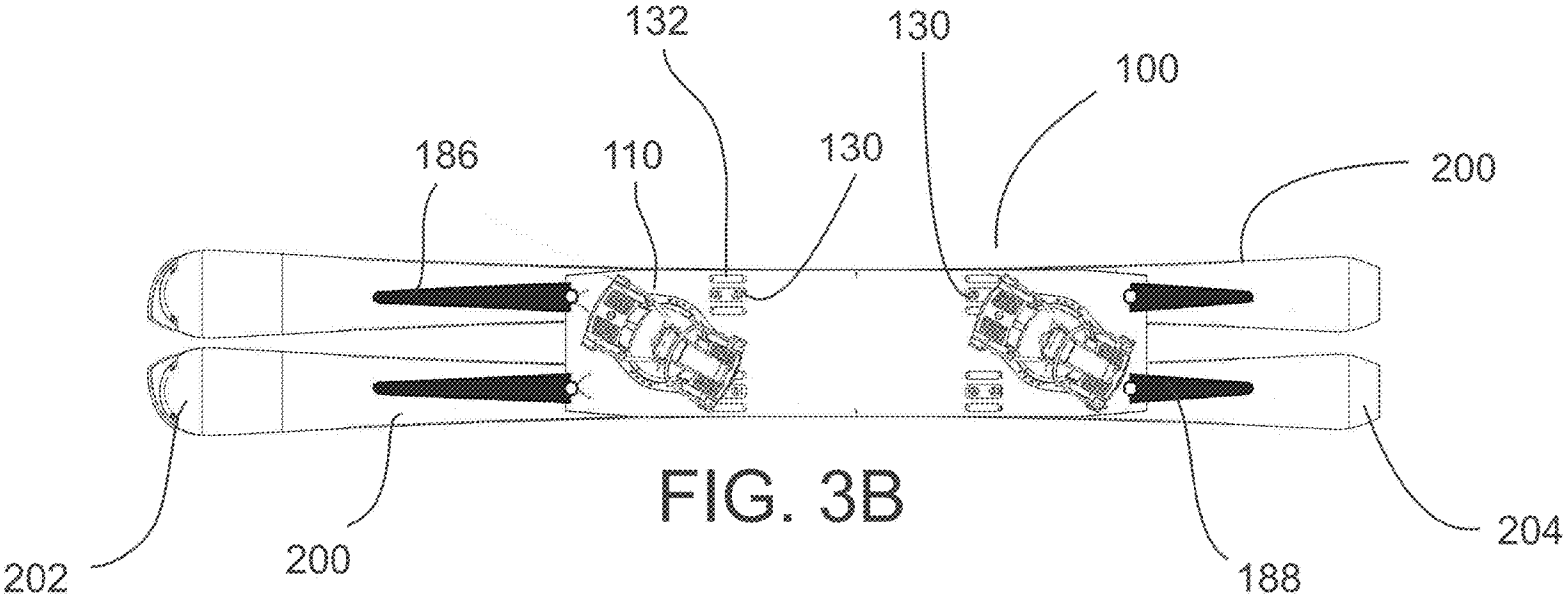
FIG. 3B is a top view of the platform mounted on top of a pair of skis with a pair of bindings and front and rear snow sticks.

To provide for shock absorption and vibration damping, some embodiments include a pair of snow sticks 186/188 per ski 200, as shown in FIGS. 3A-3B. A front flexible snow stick 186 exerts downward force on a forward tip portion 202 of the ski 200 and attaches to a forward portion of the platform 100, and a rear flexible snow stick 188 exerts downward force on a rear tail portion 204 of the ski 200 and attaches to a rear portion of the platform 100. The snow sticks 186/188 are configured to exert external pressure on to the forward tip portion 202 of the ski 200 and the rear tail portion 204 of the ski 200 to control flexure of the ski 200, whereby the sticks 186/188 stop vibrations in the ski 200.

In an exemplary embodiment for a method for converting a pair of skis 200 into a mono board for emulation of snowboarding, the steps include: providing a pair of skis 200, removing a ski 200 binding from each ski 200 (if a binding is installed on either/each ski), providing a platform 100 with a mounting system 104, utilizing the mounting system 104 to affix the platform 100 to each ski 200, and attaching a pair of snowboard bindings 110 to the platform 100.

The method further continues with the steps of providing a plurality of mounting bolts (not shown, but should be appreciated as a standard screw or bolt) configured to pass through the apertures 116 in the mounting brackets 112 and engage with the holes 182 in the pair of skis 200 or racing plate 180, and the method includes affixing each of the four mounting brackets 112 to the skis 200 or race plate 182. Each ski 200 receives a pair of mounting brackets 112 that are fastened to the skis 200 by the plurality of mounting screws (not shown, but should be understood as a standard screw or bolt) inserted through the apertures 116 in the mounting brackets 112 and engaged with the holes 182 in the pair of skis.

The method further continues by the steps of aligning the platform 100 to the mounting brackets 112. The platform 100 is configured to include a plurality of mounting locations 106, wherein each mounting location 106 corresponds to a location of each of the mounting brackets 112 and each mounting location 106 having a series of three recesses 176*a*/176*b*/176*c*, whereby a center recess 176*b* in the series of three recesses is configured to align with the protrusions 122 on each mounting bracket 112.

Next, the method includes inserting a pair of slider blocks 132, including a first slider block (see outer slider block 132) and a second slider block (see inner slider block 132), into outer recesses 176*a*/176*c* relative to an inner recess 176*c* in the three recesses 176*a*/176*b*/176*c* in each mounting location 106. Each slider block 132 includes a horizontal aperture 134 in its broad side 136 extending through each of the slider blocks 132.

Further, the method provides the steps of inserting a series of shoulder bolts 126 into apertures 142 in sidewalls 138 of the platform 100, wherein the platform 100 is configured to have four sidewall 138 apertures 142 each corresponding to a mounting location 106. The shoulder bolt 126 extends through: the sidewall aperture 142, the horizontal aperture 134 in the first slider block 132, the first divider wall 178*b*, the channel between 120 the protrusions 122 on the mounting bracket 112, the second divider wall 178*a*, the horizontal aperture 134 in the second slider block 132, and the threaded opening 148 in the inner sidewall of the innermost recess 176*c* of the mounting location 106.

Next, the method includes the steps of providing a plurality of slider locks 130, each corresponding with a mounting bracket 112, and configured to have a center channel 150 for complemental insertion of the shoulder bolt. Each slider block 132 has a pair of apertures 156 corresponding with each of the protrusions 122 in the mounting brackets 112.

The method also provides for aligning apertures 156 on the slider lock 130 to the threaded apertures 124 in the top surface 152 of the protrusions 122 in the mounting brackets 112, and aligning the center channel 150 of the slider lock 130 to the center channel 120 of the mounting brackets 112, providing a pair of locking bolts 128/154 per slider lock 130, and inserting the locking bolts 128/154 through each aperture 156 in the slider lock 130 and securing the locking bolts 128/154 to the threaded apertures 124 in the protrusions 122 in the mounting brackets 112.

In some embodiments, the platform 100 with a mounting system 104 in the step of providing a platform 100 with a mounting system 104 further includes the structure as described in the exemplary embodiment above, and as shown in FIGS. 1-17.

In some embodiments, the pair of skis 200 in the step of providing a pair of skis 200 is a pair of shaped skis. This provides a particular benefit because shaped skis may be purchased off the shelf, or may already be in the possession of a user, and thus, the invention does not require a specialized pair of skis.

In some embodiments, the step for utilizing the mounting system 104 to affix the platform 100 to each ski 200 further includes placing the skis 200 in a parallel orientation, drilling a plurality of holes 182 in each ski 200 in the pair of skis 200, and providing four mounting brackets 112. Each mounting bracket 112 includes mounting apertures 116 configured to align with the plurality of drill holes 182 in the pair of skis 200. Each mounting bracket 112 includes a pair of protrusions 122 on an upper surface 152 thereby creating a channel 120 therebetween. Each protrusion 122 includes a threaded aperture 124 on its upper surface 152.

In some embodiments, the method further includes configuring the platform 100 to perform like a convex snowboard by flipping an orientation of the pair of outermost slider blocks 132, closest to the sidewall 138, to have the aperture 134 in its broad side 136 closer to a bottom surface and the pair of innermost slider blocks 132 to have the aperture 134 in its broad side 136 closer to a top surface. This will result in the performance as a convex snowboard. As may be seen in FIG. 12B, the aperture 134 in the broad side 136 has a thinner distance 158 on one side of the slider block, and a thicker distance 160 on the other side of the slider block 132. That is, the slider blocks 132 can be flipped to move the aperture 134 in a position towards a top or bottom. When the outermost slider block has an aperture 134 towards the lower section, the shoulder bolt 126 will be skewed, and affect the camber of the skis 200, as shown in FIG. 15A with the positive camber. Alternatively, the method also includes for configuring the platform 100 to perform like a concave snowboard by flipping an orientation of the outermost slider blocks 132 to have the aperture 134 in its broad side 136 closer to a top surface and the innermost slider blocks 132 to have the aperture 134 in its broad side 136 closer to a bottom surface, if performance of a concave snowboard is desired.

Figure 11A:
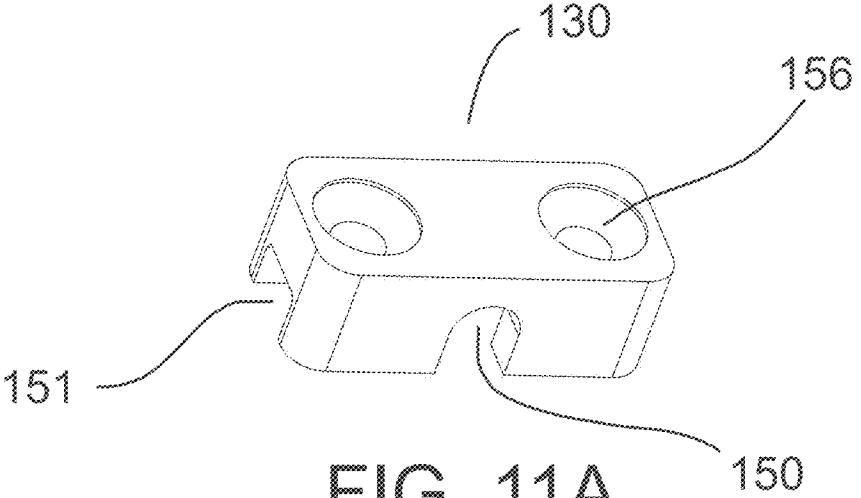
FIG. 11A is an isometric top view of a slider lock with single-space channel.
Figure 11B:
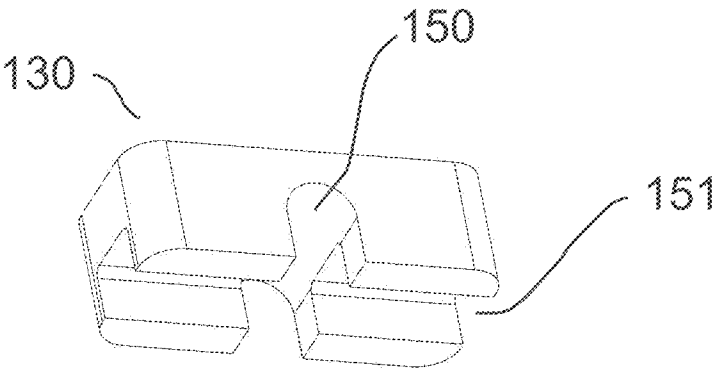
FIG. 11B is an isometric bottom view of the slider lock of FIG. 11A.
Figure 11C:
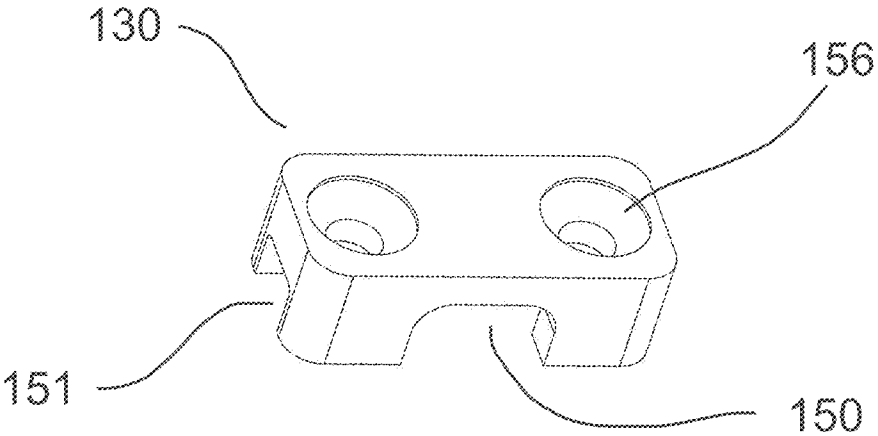
FIG. 11C is an isometric top view of a slider lock with an elongated channel.
Figure 11D:
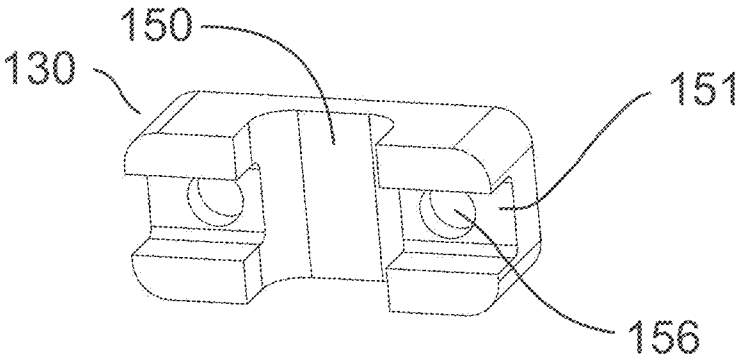
FIG. 11D is an isometric bottom view of the slider lock of FIG. 11A.
Figure 12B:
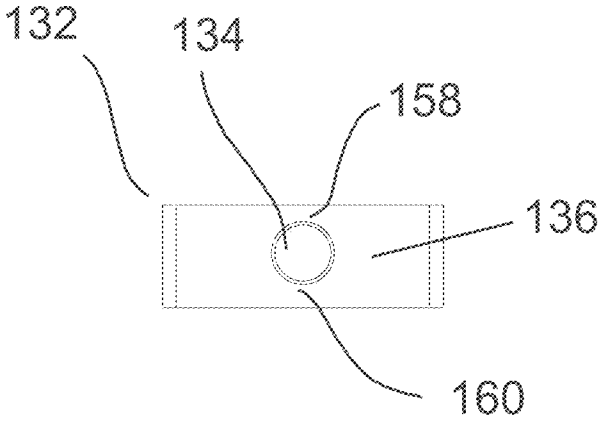
FIG. 12B is a side view of the slider block of FIG. 12A.
Figure 12A:
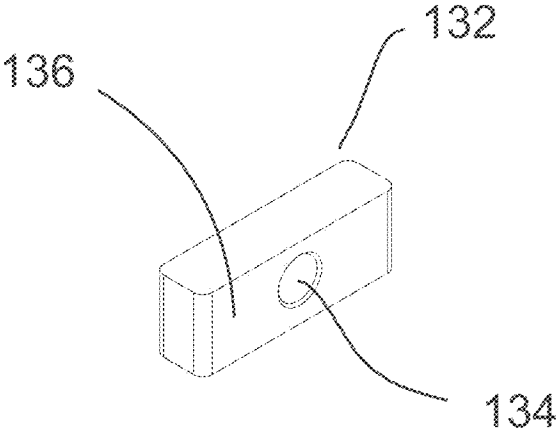
FIG. 12A is a front isometric view of the slider block.
Figure 13A:
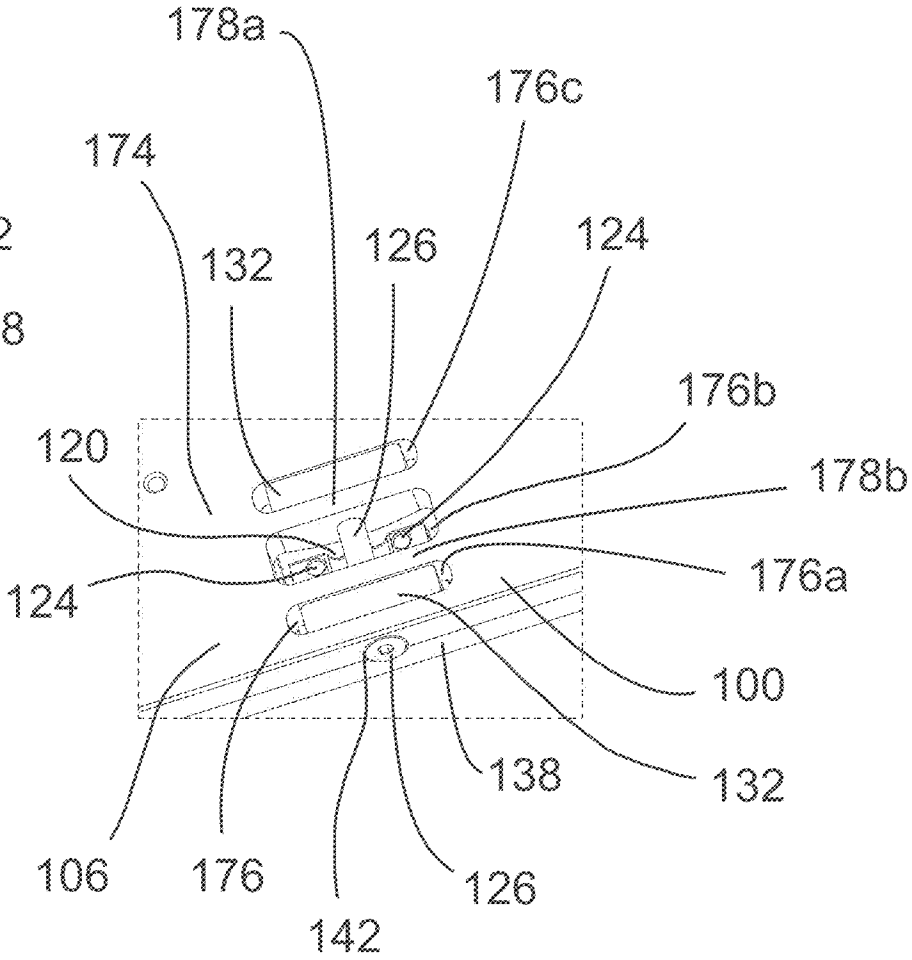
FIG. 13A is an isometric view of the mounting system with slider lock removed.
Figure 13B:
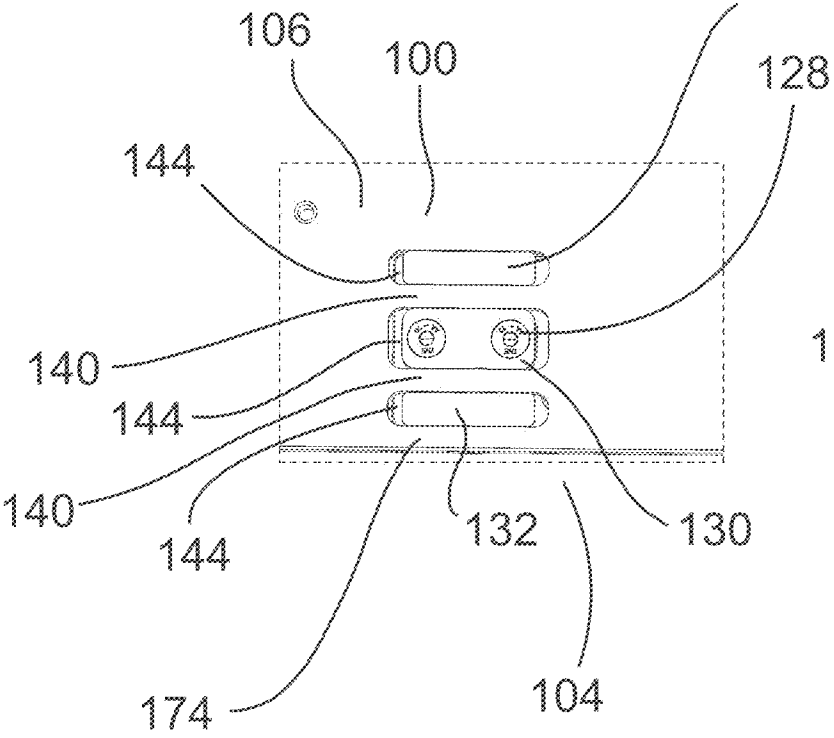
FIG. 13B is a top isometric view of the mounting system with slider lock.
Figure 14:
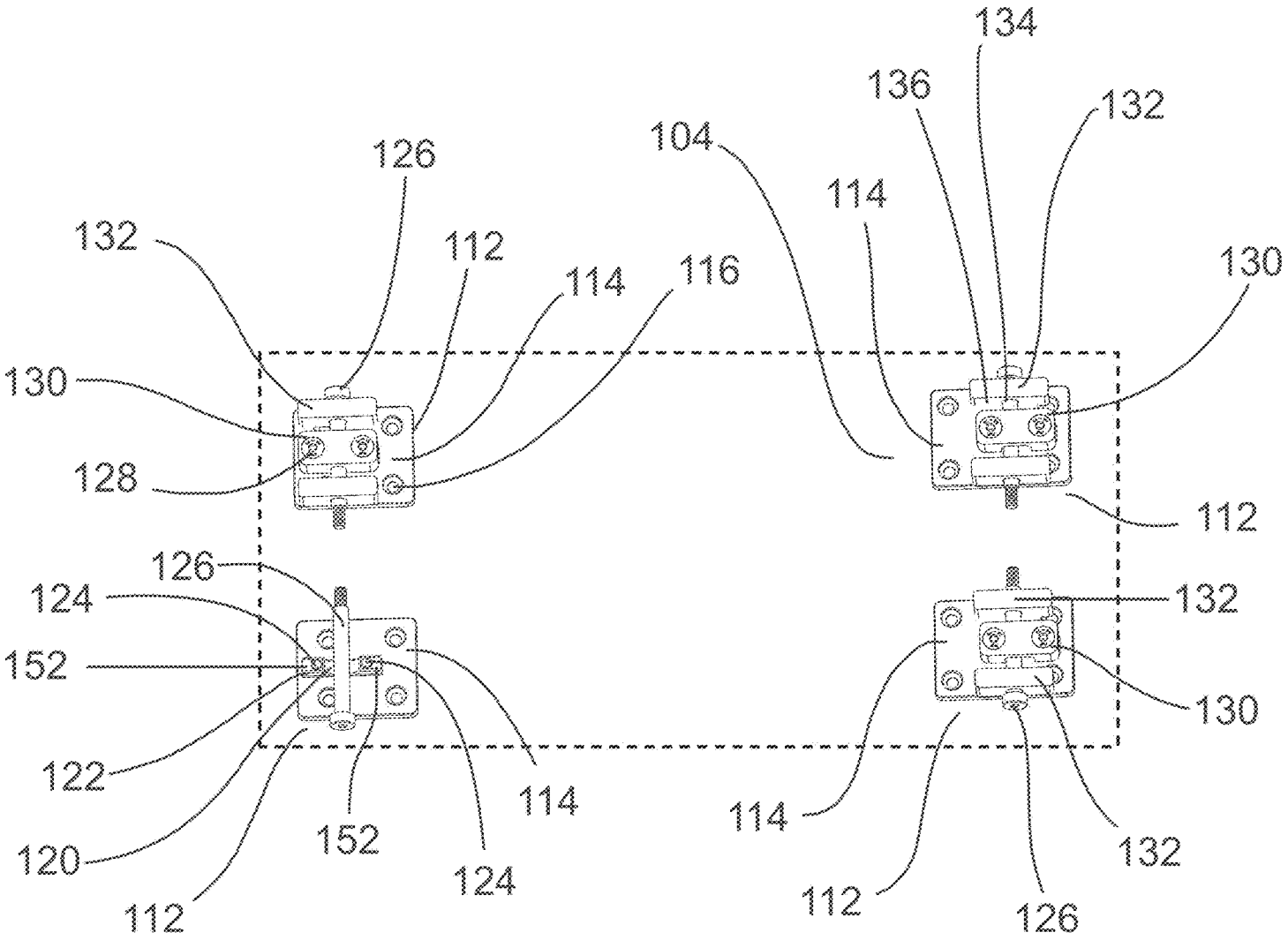
FIG. 14 is an isolated view of the mounting system of the platform illustrating four mounting locations.

In some embodiments, the method further includes the step of configuring the mounting system 104 to precisely emulate the turning mechanics of a snowboard by providing for increased flexibility of the emulated snowboard. This includes configuring a pair of mounting brackets 112 to have an elongated channel 120 therein to accommodate front to back movement of the shoulder bolt 126. In some embodiments, a front pair of brackets 112 may have an elongated channel 120, and in some embodiments a rear pair of brackets 112 may have an elongated channel 120. In some embodiments, the front pair of mounting brackets 112 have a standard channel 120 if the rear mounting brackets 112 have an elongated channel 120, and in some embodiments, the rear mounting brackets 112 have a standard channel 120 if the front mounting brackets 112 have an elongated channel 120. This further includes configuring a complemental pair of slider locks 130 to have an elongated channel 150, as shown in FIGS. 11C and 11D, to thereby slidably secure the shoulder bolt 126 within the channel 150, thereby eliminating sheering between the platform 100 and the skis 200 allowing the skis 200 to flex correctly and thereby keeping the skis 200 from locking up.

In some embodiments, when an intermediary plate 180 is not already attached to the ski 200, the method further includes the step of attaching an intermediary plate 180 to each ski 200 prior to affixing the platform 100 to the skis 200. This step, for each intermediary plate 180, includes providing an intermediary plate 180 with a plurality of apertures 182 for mounting the intermediary plate 180, drilling mounting holes in each ski 200 in the pair of skis 200 (if holes are not already existing), mounting the intermediary plate 180 to each ski 200 in the pair of skis 200 by aligning holes 182 in the intermediary plate 180 to the mounting holes in the skis 200, and securing a threaded bolt 184 through the aperture 182 into the mounting holes in the skis 200. In some embodiments, the intermediary plate 180 may be a race plate 180, configured to provide additional flexibility for radial turning, wherein the race plate 180 allows the platform 100 the ability to remain stiff while the skis 200 are allowed a degree of flex.

In some embodiments, the method further provides for including a pair of ski sticks 186/188 for each platform 100. Each ski stick 186/188 is configured to attach a forward end of the platform 100 to a forward end of each ski, 200 and attach a rear end of the platform 100 to a rear end of each ski 200. The ski sticks 186/188 provide stiffness to each ski 200 to prevent over flexing and encourage vibration damping.

In some embodiments, the method further includes configuring the platform 100 for structural rigidity by forming cross bracing 166 into an underside 162 of the platform 100. Further, to prevent snow buildup, a user may take the additional step of fastening a plate 170 to a centerline 172 of the cross bracing 166.

In some embodiments, the step of utilizing the mounting system 104 to affix the platform to each ski 200 further includes placing the skis 200 in a parallel orientation and providing four mounting brackets 112. Each mounting bracket 112 includes mounting apertures 116 configured to align with the plurality of threaded apertures 182 in each of the intermediary plates 180. Further, each mounting bracket 112 includes a pair or protrusions 122 on an upper surface 152 thereby creating a channel 120 therebetween, wherein each protrusion 122 includes a threaded aperture 124 on its upper surface 152. In addition, the step includes providing a plurality of mounting bolts (not shown) configured to pass through the apertures 116 in the mounting brackets 112 and engage with the threaded apertures 182 in the intermediary plates 180. Further, the step includes affixing each of the four mounting brackets 112 to the intermediary plates 180, wherein each ski 200 received a pair of mounting brackets 112 that are bolted to each of the intermediary plates 180 by the plurality of mounting bolts (not shown) inserted through the apertures 116 in the mounting brackets 112 and engaged with the holes 182 in intermediary plates 180. Next, the step includes aligning the platform 100 to the mounting brackets 112. The platform 100 is configured to include a plurality of mounting locations 106. Each mounting location 106 corresponds to a location of each of the mounting brackets 112 and each mounting location 106 having a series of three recesses 176*a*/176*b*/176*c*, whereby a center recess 176*b* in the series of three recesses 176*a*/176*b*/176*c* is configured to align with the protrusions 122 on each mounting bracket 112. Next, the method step provides for inserting a pair of slider blocks 132, including a first slider block 132 and a second slider block 132, into outer recesses 176*a*/176*c* in the three recesses 176*a*/176*b*/176*c* in each mounting location 106. Each slider block 132 includes a horizontal aperture 134 in its broad side 136 extending through each of the slider blocks 132, a user may continue the process by inserting a series of shoulder bolts 126 into apertures 142 in sidewalls 138 of the platform 100. The platform 100 is configured to have four sidewall apertures 142 each corresponding to a mounting location 106, wherein the shoulder bolt 126 extends through the sidewall aperture 142, then the horizontal aperture 136 in the first slider block 132, then the first divider wall 178*b*, then the channel 120 between the protrusions 122 on the mounting bracket 112, then the second divider wall 178*a*, then the horizontal aperture 134 in the second slider block 132, and then into the threaded opening 148 in an inner sidewall of an innermost recess 176*c* of the mounting location 106. The method step also includes providing a plurality of slider locks 130, each corresponding with a mounting bracket 112, and configured to have a center channel 150 for complemental insertion of the shoulder bolt 126, and each slider lock 130 having a pair of apertures 156 corresponding with threaded apertures 124 of each of the protrusions 122 in the mounting brackets 112. Next the method includes aligning the apertures 156 on the slider lock 130 to the threaded apertures 124 in the top surface 152 of the protrusions 122 in the mounting brackets 112, and aligning the center channel 150 of the slider lock 130 to the center channel 120 of the mounting brackets 112. The method step in this embodiment may be completed by providing a pair of locking bolts 154 per slider lock 130, and inserting the locking bolts 154 through each aperture 156 in the slider lock 130 and securing the locking bolts 154 to the threaded apertures 124 in the protrusions 122 in the mounting brackets 112.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A method for converting a pair of skis into a mono board for emulation of snowboarding, comprising:

providing a pair of skis;

removing a ski binding from each ski in said pair of skis, if a binding is installed on either ski in said pair of skis;

providing a platform with a mounting system;

utilizing said mounting system to affix said platform to each ski in said pair of skis;

attaching a pair of snowboard bindings to said platform;

wherein the platform with a mounting system in said step of providing a platform with a mounting system further includes:

said platform having an upper planar surface with a plurality of recessed cavities therein for said mounting system, wherein said mounting system includes:

a mounting bracket having a plate with a plurality of apertures therein for bolts that, when inserted, affix the mounting plate to a plurality of ski connection locations, a pair of upward protrusions creating a channel therebetween for containing a shoulder bolt, and threaded apertures at a top surface of each of said protrusions for complemental engagement with locking bolts that, when inserted, affix a slider lock;

a pair of slider blocks for each mounting bracket, wherein each slider block contains an aperture in its broad side extending through said slider block;

sidewalls in said platform having a series of sidewall apertures therein for insertion of a shoulder bolt;

a shoulder bolt extending through a series of apertures, including said sidewall aperture, said apertures in said sidewalls of said cavities, a first slider block, through said channel of said mounting bracket, and through a second slider block fixing to a threaded opening formed into said platform;

a slider lock, with center cutout, and channel, wherein said center cutout is configured for the insertion of said shoulder bolt, whereby said slider lock bridges a gap between a top of said upward protrusions of said mounting bracket thereby closing off said channel for containment of said shoulder bolt; and said slider bolt affixable to said upward protrusions on said mounting bracket by insertion of said locking bolts through a pair of apertures in said slider block and securing to said threaded apertures in said top surface of said upward protrusions;

said mounting system configured to affix said platform to a pair of skis thereby forming said pair of skis into a single mono-board with independent tips and tails, wherein said platform connects to a middle of each ski in said pair of skis to form an emulation snowboard; and said plate including a plurality of binding apertures, whereby said apertures are configured for receiving mounting screws for snowboard bindings;

said plurality of recessed cavities include:

four mounting locations;

each of said mounting locations corresponding with a location of a ski connection location in said plurality of ski connection locations, wherein said plurality of ski connection locations defines four locations, whereby two locations exist per ski in said pair of skis;

each mounting location in said four mounting locations includes a series of three parallel cavities separated by a divider; and said slider blocks are inserted into two outer cavities per mounting location in said four mounting locations, and said slider lock is inserted into a center cavity per mounting location in said four mounting locations.

2. The method, as recited in claim 1, wherein said pair of skis in said step of providing a pair of skis is a pair of shaped skis.

3. The method, as recited in claim 1, further comprising:

configuring said platform to perform like a convex snowboard by flipping an orientation of said pair of outermost slider blocks to have said aperture in its broad side closer to a bottom surface and said pair of innermost slider blocks to have said aperture in its broad side closer to a top surface, if performance of a convex snowboard is desired; and configuring said platform to perform like a concave snowboard by flipping an orientation of said outermost slider blocks to have said aperture in its broad side closer to a top surface and said innermost slider blocks to have said aperture in its broad side closer to a bottom surface, if performance of a concave snowboard is desired.

4. The method, as recited in claim 1, further comprising:

configuring said mounting system to precisely emulate the turning mechanics of a snowboard by providing for increased flexibility of the emulated snowboard by:

configuring a pair of mounting brackets to have an elongated channel therein to accommodate front to back movement of said shoulder bolt, wherein said pair of mounting brackets are chosen from the group consisting essentially of a front pair of mounting brackets and a rear pair of mounting brackets, wherein said front pair of mounting brackets have a standard channel if said rear mounting brackets have an elongated channel, and said rear mounting brackets have a standard channel if said front mounting brackets have an elongated channel; and configuring a complemental pair of slider locks to have an elongated channel to thereby slidably secure said shoulder bolt within said channel, thereby eliminating sheering between the platform and said skis allowing the skis to flex correctly and thereby keeping the skis from locking up.

5. The method, as recited in claim 1, further comprising:

including a pair of ski sticks for each platform, wherein each ski stick is configured to attach a forward end of said platform to a forward end of each ski, and attach a rear end of each of said platforms to a rear end of each ski, wherein said ski sticks provide stiffness to each ski to prevent over flexing and encourage vibration damping.

6. The method, as recited in claim 1, further comprising:

configuring said platform for structural rigidity by forming cross bracing into an underside of said platform; and fastening a plate to a centerline of said cross bracing to prevent snow buildup.

7. A method for converting a pair of skis into a monoboard for emulation of snowboarding, comprising:

providing a pair of skis;

removing a ski binding from each ski in said pair of skis, if a binding is installed on either ski in said pair of skis;

providing a platform with a mounting system;

utilizing said mounting system to affix said platform to each ski in said pair of skis; and attaching a pair of snowboard bindings to said platform; and wherein said step for utilizing said mounting system to affix said platform to each ski in said pair of skis further includes:

placing said skis in a parallel orientation;

drilling a plurality of holes in each ski in said pair of skis;

providing four mounting brackets, wherein each mounting bracket in said four mounting brackets includes mounting apertures configured to align with said plurality of drill holes in said pair of skis, and wherein each mounting bracket in said four mounting brackets includes a pair of protrusions on an upper surface thereby creating a channel therebetween, wherein each protrusion includes a vertical threaded aperture on its upper surface for engaging with a locking bolt to secure a slider lock;

providing a plurality of mounting bolts configured to pass through said apertures in said mounting brackets and engage with said holes in said pair of skis;

affixing each of said four mounting brackets to said skis, wherein each ski receives a pair of mounting brackets that are fastened to said skis by said plurality of mounting screws inserted through said apertures in said mounting brackets and engaged with said holes in said pair of skis;

aligning said platform to said mounting brackets, wherein said platform is configured to include a plurality of mounting locations, wherein each mounting location corresponds to a location of each of said mounting brackets and each mounting location having a series of three recesses, whereby a center recess in said series of three recesses is configured to align with said protrusions on each mounting bracket;

inserting a pair of slider blocks, including a first slider block and a second slider block, into outer recesses in said three recesses in each mounting location, wherein each slider block includes a horizontal aperture in its broad side extending through each of said slider blocks;

inserting a series of shoulder bolts into apertures in sidewalls of said platform, wherein said platform is configured to have four sidewall apertures each corresponding to a mounting location, wherein said shoulder bolt extends through:

said sidewall aperture;

said horizontal aperture in said first slider block;

a first divider wall;

said channel between said protrusions on said mounting bracket;

a second divider wall;

said horizontal aperture in said second slider block; and a threaded opening in an inner sidewall of an innermost recess of said mounting location;

providing a plurality of slider locks, each corresponding with a mounting bracket, and configured to have a center channel for complemental insertion of said shoulder bolt, and each slider block in said plurality of slider blocks having a pair of apertures corresponding with each of said protrusions in said mounting brackets;

aligning apertures on said slider lock to said threaded apertures in said top surface of said protrusions in said mounting brackets, and aligning said center channel of said slider lock to said center channel of said mounting brackets;

providing a pair of locking bolts per slider lock; and inserting said locking bolts through each aperture in said slider lock and securing said locking bolts to said threaded apertures in said protrusions in said mounting brackets.

8. A method for converting a pair of skis into a monoboard for emulation of snowboarding, comprising:

providing a pair of skis;

removing a ski binding from each ski in said pair of skis, if a binding is installed on either ski in said pair of skis;

providing a platform with a mounting system;

utilizing said mounting system to affix said platform to each ski in said pair of skis;

attaching a pair of snowboard bindings to said platform;

attaching an intermediary plate to each ski in said plurality of skis prior to affixing said platform to said skis, if an intermediary plate is not already attached to said ski, wherein each intermediary plate includes:

providing an intermediary plate with a plurality of apertures for mounting said intermediary plate;

drilling mounting holes in each ski in said pair of skis if holes are not already existing;

mounting said intermediary plate to each ski in said pair of skis by aligning holes in said intermediary plate to said mounting holes in said skis;

securing a threaded bolt through said aperture into said mounting holes in said skis;

wherein said step of utilizing said mounting system to affix said platform to each ski in said pair of skis further includes:

placing said skis in a parallel orientation;

providing four mounting brackets, wherein each mounting bracket in said four mounting brackets includes mounting apertures configured to align with said plurality of threaded apertures in each of said intermediary plates, and wherein each mounting bracket in said four mounting brackets includes a pair of protrusions on an upper surface thereby creating a channel therebetween, wherein each protrusion includes a threaded aperture on its upper surface;

providing a plurality of mounting bolts configured to pass through said apertures in said mounting brackets and engage with said threaded apertures in said intermediary plates;

affixing each of said four mounting brackets to said intermediary plates, wherein each ski received a pair of mounting brackets that are bolted to each of said intermediary plates by said plurality of mounting bolts inserted through said apertures in said mounting brackets and engaged with said holes in intermediary plates;

aligning said platform to said mounting brackets, wherein said platform is configured to include a plurality of mounting locations, wherein each mounting location corresponds to a location of each of said mounting brackets and each mounting location having a series of three recesses, whereby a center recess in said series of three recesses is configured to align with said protrusions on each mounting bracket;

inserting a pair of slider blocks, including a first slider block and a second slider block, into outer recesses in said three recesses in each mounting location, wherein each slider block in includes a horizontal aperture in its broad side extending through each of said slider blocks;

inserting a series of shoulder bolts into apertures in sidewalls of said platform, wherein said platform is configured to have four sidewall apertures each corresponding to a mounting location, wherein said shoulder bolt extends through:

said sidewall aperture;

said horizontal aperture in said first slider block;

a first divider wall;

said channel between said protrusions on said mounting bracket;

a second divider wall;

said horizontal aperture in said second slider block; and a threaded opening in an inner sidewall of an innermost recess of said mounting location;

providing a plurality of slider locks, each corresponding with a mounting bracket, and configured to have a center channel for complemental insertion of said shoulder bolt, and each slider block in said plurality of slider blocks having a pair of apertures corresponding with each of said protrusions in said mounting brackets;

aligning apertures on said slider lock to said threaded apertures in said top surface of said protrusions in said mounting brackets, and aligning said center channel of said slider lock to said center channel of said mounting brackets;

providing a pair of locking bolts per slider lock; and inserting said locking bolts through each aperture in said slider lock and securing said locking bolts to said threaded apertures in said protrusions in said mounting brackets.

9. The method, as recited in claim 8, wherein said intermediary plate is a race plate, configured to provide additional flexibility for radial turning, wherein said race plate allows the platform the ability to remain stiff while the skis are allowed a degree of flex.

* * * * *